US008151812B2

(12) United States Patent
Razon

(10) Patent No.: US 8,151,812 B2
(45) Date of Patent: Apr. 10, 2012

(54) SIT DOWN AND STAND UP WALKER WITH SEAT ASSEMBLY

(76) Inventor: Eli Razon, Maple Glen, PA (US)

( * ) Notice: Subject to any disclaimer, the term of this patent is extended or adjusted under 35 U.S.C. 154(b) by 0 days.

(21) Appl. No.: 12/803,718

(22) Filed: Jul. 2, 2010

(65) Prior Publication Data

US 2012/0000496 A1 Jan. 5, 2012

(51) Int. Cl.
*A61H 3/04* (2006.01)

(52) U.S. Cl. ..... 135/66; 135/67; 297/5; 297/195.1

(58) Field of Classification Search ..... 135/66, 135/67; 297/5, 195.11, 195.1, 195.12, 338, 297/334.12, 334.19
See application file for complete search history.

(56) References Cited

U.S. PATENT DOCUMENTS

| | | | | |
|---|---|---|---|---|
| 458,136 | A * | 8/1891 | Wilder | 472/110 |
| 2,991,485 | A * | 7/1961 | Schulte | 5/87.1 |
| 3,374,493 | A * | 3/1968 | Herrera | 5/86.1 |
| 3,599,962 | A * | 8/1971 | Henry | 269/182 |
| 4,187,869 | A * | 2/1980 | Marchetti | 135/67 |
| 4,188,966 | A * | 2/1980 | Palmer et al. | 135/67 |
| 4,211,426 | A * | 7/1980 | Motloch | 280/87.041 |
| 5,502,851 | A | 4/1996 | Costello | |
| 5,558,358 | A * | 9/1996 | Johnson | 280/648 |
| 6,135,131 | A * | 10/2000 | Downing | 135/67 |
| 6,224,154 | B1 * | 5/2001 | Stoki | 297/339 |
| 6,343,802 | B1 * | 2/2002 | Workman et al. | 280/87.041 |
| 6,503,176 | B2 | 1/2003 | Kuntz | |
| 6,619,681 | B2 * | 9/2003 | Gutierrez | 280/250.1 |
| 6,619,735 | B1 * | 9/2003 | Ming-Hwa | 297/170 |
| 6,733,018 | B2 | 5/2004 | Razon | |
| 7,275,554 | B2 | 10/2007 | Mullholand | |

* cited by examiner

*Primary Examiner* — Noah Chandler Hawk
(74) *Attorney, Agent, or Firm* — Joel E. Oshtry - Atty.

(57) ABSTRACT

A sit down and stand up walker for assisting a user during walking and when not walking in a standing, partially standing or sitting positions with partial or full weight bearing support and with means to change from standing, partially standing to sitting positions with partial weight bearing support to a fixed elevation with full weight bearing support in any varied or repeated sequence. The partial or full weight bearing means supports a seat assembly which includes a seat and front body support with adjustable positioning to provide pelvic stability. The angle of the seat assembly relative to a flat ground surface is maintained at any elevation of the seat assembly between a standing and sitting position. The weight bearing means is responsive to the variable force supplied by the user as the user walks, stands or sits allowing the seat assembly to move up or down. The weight bearing means in a preferred embodiment is an enclosed gas spring cylinder with piston rod that can be locked at differing elevations or released to respond to a user's body force as the user walks, stands or sits. The walker is intended to be moved without the user's hands holding onto the frame thereby promoting a normal gait and posture. The walker enables the user to expend less energy as the body's center of gravity with partial or full weight bearing support rises and falls with each stride. The walker facilitates transfers from a sitting to standing positions and vice versa by the user independently without the intervention of caregivers.

12 Claims, 15 Drawing Sheets

SIT DOWN AND STAND UP WALKER WITH SEAT ASSEMBLY

BACKGROUND OF THE INVENTION

1. Field of the Invention

The present invention relates to walkers with a stabilizing seat assembly for use by handicapped or physically impaired persons and for those individuals undergoing rehabilitative activity. More particularly, the present invention relates to a partial weight-bearing walker which assists a person in walking and when rising from a seated to a standing/walking position and back down from standing/walking to sitting position while minimizing or eliminating assistance from caregivers.

2. Description of the Prior Art

Individuals in a physically impaired or weakened condition whether due to an illness, medical condition or injury who attempt to transfer from a sitting to a standing position to use a walker and then sit down again are at risk for falling. These individuals often need the assistance of others to help them stand up to use a walker and to accompany them as they ambulate with the walker and when they transfer from a standing to a sitting position. Individuals who do so without the assistance of others are at an increased risk for falling and injuring themselves. The Center for Disease Control (CDC) estimates 10 million individuals over 65 fall every year in the United States. Of those, 1.6 million require emergency medical care with approximately 200,000 breaking their hip and approximately 100,000 with head injuries. The reason many individuals fall is due to loss of balance secondary to insufficient leg strength as they move around or transfer from a sitting to a standing position and vice versa. Another cause of falls resulting in injury involves individuals who suffer a sudden weakness or collapse of their legs or musculature which fails to support their body resulting in the fall.

Adaptive walkers are known which usually require another person to assist an individual as they stand up in preparation for using the walker. Walkers are known which require the user to hold on to it with the hands for balance, support and steering of the walker. In such walkers the upper extremities are required to transmit the force to move the walker and the user is caused to tend to not use a natural walking gait but to shuffle without raising the user's center of gravity and to hunch over the arms and hands.

In many walkers the user becomes easily fatigued and can only move short distances. This is because of the effort required to support the user's weight, maintain balance and push the walker through use of the arms. These adaptive walkers often require another person to accompany the user to prevent injury in the event the user suffers a sudden loss of balance, weakness or collapse.

U.S. Pat. No. 7,275,554 to Mullholand discloses an assistive walking device which supports the user's body with multiple body weight spring means.

U.S. Pat. No. 6,733,018 to Razon discloses a stand-up walker with a pair of adjustable arms and a harness which lifts and supports the user while walking.

U.S. Pat. No. 6,503,176 to Kuntz discloses a walker device with a support sling assembly and power assisted lift.

U.S. Pat. No. 5,502,581 to Costello relates to an assistive lifting, standing and walking device.

A walker which minimizes or eliminates the need for another individual to assist and accompany a physically impaired user of a walker as the user stands, walks and sits with the walker and use a walker safely is desirable. A seat assembly which helps stabilize the user's body position and maintain the user's balance is desirable.

A seat assembly which helps stabilize the user's body position and maintain the user's balance is desirable.

Walkers which allow the user to move and maintain balance without requiring the user to hold on to the walker are advantageous because they allow for improved posture, the development of a more natural walking gait and freedom of the hands. A walker which does not rely on contact with any part of the body other than the pelvic and abdominal area to propel the walker (i.e. chest, arms, etc.) frees the user to use natural gait and permits freedom of movement for other parts of the body, thereby increasing ease and confidence of use and maximizes the beneficial effect of the physical exercise on the body.

There is a need for a walker which enables an individual with impaired strength in the lower extremities to independently without the assistance of others, stand, walk, sit and rest until he is ready to resume walking and then repeatedly alternate between the standing/walking phase and the sitting/resting phase at will and with ease.

There is a need for a walker which enables the user to walk with less expenditure of energy or enables the walker to travel a greater distance than he would otherwise be able before he is fatigued as well as for a device which allows the user to variably adjust the force he exerts on his lower extremities to exercise, rehabilitate or gradually strengthen his lower extremities.

Specifically, there is a need for a walker which enables the user to independently transfer from a seat, chair, bed or toilet to a standing position and vice versa who might otherwise require assistance. Walkers are also needed which stabilize and safeguard the user in the event the user suffers sudden loss of leg or body strength or balance.

There is a need for a seat assembly to be used with a walker or other device in which a user stands or sits and engages in a physical movement such as with a bicycle or stationary exercise bicycle. Once the user's balance is maintained the user can engage in a variety of physical activities such as walking, standing or moving legs in a circular pedaling motion.

Such a device will not only increase the confidence and sense of self-worth in physically challenged individuals, but alleviates in part some of the demands placed upon caregivers in a private or institutional setting. The use of the walker described herein will eliminate the need for the assistance of caregivers when walking or transferring from a sitting to a standing position and vice versa for some patients. The use of the walker described herein will at least enable the caregivers to exert less physical force than would otherwise be required thereby lessening the frequency of physical injuries to caregivers from lifting and supporting patients.

Walkers which promote good posture, a natural walking gait and the development of strength and rehabilitation in the user and thereby avoid making the user more dependent on the walker instead of less dependent are desirable.

SUMMARY OF THE INVENTION

The invention effectively enables physically impaired individuals to more independently walk and transfer from sitting to standing to walking and vice versa with the assistance of the walker while providing safeguards to protect against loss of balance or sudden weakness. The walker enables the user to be lifted to an upright position, walk, rest while in a standing position or be lowered to a sitting position to rest or transfer to a seat and then to resume an upright position and walk without the intervention of caregivers.

The walker is intended to enable the user to expend less energy in walking than would be expended if the user were to use conventional walkers. The walker enables the user to maintain a balanced stably positioned pelvis, a normal walking gait and good posture. The walker can be used for rehabilitative activity to promote the strengthening of the user and to make the user ultimately less dependent on the walker itself.

These and other objects of the invention are realized by providing a walker with wheels and a seat assembly. The seat assembly includes a seat mounted on a substantially horizontal seat support extension and a front body support mounted on a substantially vertical post which is connected to the seat support extension.

A support lever extends between the vertical post and the frame of the walker, thereby connecting the seat, front body support, seat support extension and post to the frame of the walker. The support lever is rotationally connected at one of its ends to the vertical post for the front body support and is rotationally connected at its other end to the frame.

Parallel to the support lever is a position stabilizing arm at an elevation higher than the support lever and which extends between the front body support post and the frame. The position stabilizing arm is rotationally connected at one end to the front body support post and at the other end is rotationally connected to the frame. The length of the position stabilizing arm and the length of the support lever are equal.

The position stabilizing arm and support lever which are parallel, equal in length and rotationally connected between the said post and the frame, enable the seat and front body support to maintain a constant orientation or constant angle with respect to a flat ground surface as the seat is lowered or raised. The maintenance of this constant orientation or angle with respect to a flat ground surface is crucial to imparting an overall stability and balance to the user as the user walks and his center of gravity moves up or down with each stride. The maintenance of this constant orientation or angle with respect to a flat ground surface is also important for a user's stability and balance as they shift from a standing to a sitting or partially standing position and vice versa. Otherwise, the user would be leaning back or forward, which would require the exertion of a corrective balancing movement by a user who may already be in a weakened physical condition and thereby cause the user to lose balance, confidence and motivation.

The seat is adjustably mounted on the seat support extension and can pivot in one direction to tilt the front of the seat toward the ground surface with the back of the seat raised further away from the ground surface or vice versa. The seat is preferably broader in the back than in the front with the front slightly tilted downward. The seat can be adjusted to move either toward or away from the front body support as well as tilted as aforesaid so that the user's pelvis is snugly wedged between the front body support and the seat.

The front body support is positioned at an elevation so that its lower end is at substantially the same elevation as the user's pubic bone. The front body support has a tiltable connection to the substantially vertical post so that the top edge and portion of the front body support either moves toward the user or away from the user with the corresponding bottom edge and portion moving away from or toward the user. The front body support can be raised higher or lower on the substantially vertical post to adjust its elevation. Thus, the seat and front body support with their tilt and positioning adjustments can establish the desired fit for each individual user. Straps attached to the front body support and seat may be optionally provided to wrap around the user's waist or hip to provide further support and stability.

The seat assembly as a whole provides a pelvic stabilizing system by allowing for customized position adjustments forward and backward on the seat and up and down on the front body support in combination with customized tiltable adjustments on the seat and front body support. The most secure comfortable or stabilizing fit for each user can be obtained by adjusting the position of the seat and front body support and their tilt angle. The seat and front body support form a wedge-like space which holds and helps stabilize the pelvis at the desired angle. The stabilization of the pelvis helps the user maintain balance.

The seat and front body support along with the maintenance of the angle of the seat and front body support as described aforesaid help maintain the pelvis in the same position. The stabilizing of the pelvis and the maintenance of its position helps maintain balance and imparts a more comfortable seat and seated position for the user especially as more of a support force is applied which pressure is transmitted onto the pelvic area of the user.

The walker is provided with weight support spring means which are pivotally mounted on the frame. The weight support spring means extends to and is connected with the support lever. The weight support spring means applies a predetermined support force onto the entire seat assembly, including the seat, seat support extension, front body support, front body support post, support lever, position stabilizing arm and thereby the user. The weight support spring means can be of sufficient force to fully support the weight of the user if desired.

However, during the use of the walker, it is anticipated that the user's weight shall be partially supported by the weight support spring means to allow the user to contribute his own physical efforts to his walking and standing. As the user walks with his posterior positioned upon the seat and as his center of gravity moves up and down, the weight support means provide adjustable partial weight-bearing support in accordance with the user's needs. The entire seat assembly then can dynamically change its position as the center of gravity of the user moves up and down or the user contributes more or less of his own physical effort to walking or standing.

During normal walking, a person's center of gravity moves up and down one-half to one inch. The repeated lifting up and setting down of the body's weight requires an expenditure of energy and muscular effort which an individual in a weakened physical condition can either not do or do only for a limited period of time over a short distance. The partial weight bearing support provided by the walker allows the user to walk with less expenditure of energy and muscular effort because the users weight is partially supported as the body's center of gravity rises and falls during walking.

The weight support spring means which is pivotally connected on one end to the frame can attach at variable locations along the length of the support lever resulting in variable distances from the fulcrum point of the support lever on the cross bar of the frame, thereby imparting differing mechanical advantages and to impart different adjustable partial weight bearing support to the user in accordance with the user's needs.

The walker is provided with stop means positioned on the weight support spring means to limit the downward movement of the seat and provide a fixed down position of the seat. This stop limit not only prevents the seat and the user from falling to the ground, but insures that the user will not be lowered to a position too close to the ground from which the user would encounter difficulty trying to regain a sitting or standing position. The stop means can be in the nature of an elastic or cushioned stop block or ring.

The weight support spring means is provided with a locking and release mechanism to lock the seat at variable desired locations off the ground to facilitate the transfer from sitting to standing and back to a sitting or standing position in any desired order. The locking and release mechanism facilitates changing the seat height as frequently as the user chooses. The weight support spring means with the locking and release mechanism enables the user to choose a plurality of elevational heights for the seat such as a fully standing, a partially standing or a sitting position in rapid succession and varying sequence while the user's weight is partially or fully supported.

A person who ordinarily would require other individuals to help lift him or her to a standing position can instead position the seat next to the buttock area and slide the seat which has been locked or immobilized for vertical movement into position under himself or herself until both legs are astride the seat. While sliding onto the seat the locking mechanism is activated to immobilize the seat to facilitate sliding onto the seat. The seat in its locked position fully supports the user as he or she slides onto it. Once the user is securely positioned on the seat, he or she can release the locking lever on the spring means which will then impart a lifting force to assist the user in transferring to a more upright or fully upright standing position. The user can remain in the standing position during which his weight will be partially supported reducing pressure on his muscular-skeletal system. The user can then walk with partial weight support of his body in accordance with his needs and with the seat and seat assembly moving up and down as the body's center of gravity rises and falls with each stride and with a stably balanced and positioned pelvis. This enables a normal walking gait to be used and requires less energy to walk.

The walker is intended to be used without the user contacting or holding his hands on the frame but rather for the user's hands to be free for other functions. The user, however, can choose to hold onto the frame of the walker.

When the body weight support spring means is placed in a dynamic mode, namely when the piston rod is unlocked and free to retract into or extend out from the gas cylinder in response to forces imparted by the user as the user moves or activates muscle groups in differing degrees, the user can exercise with the walker. Thus the walker can be used for rehabilitative activity. As the user gains strength the user can exert more muscular effort in accordance with his capability and needs. The user can also adjust the partial weight bearing force supplied by changing the location of the attachment of the spring means along the length of the support lever as described elsewhere herein. That is the distance of the attachment from the fulcrum point of the support lever on the cross bar will affect the weight bearing support supplied.

Should the user tire and seek to stop walking, the user can lock the locking lever on the spring means and sit on the seat with his full weight supported. It should be understood that the user can continue to move and walk with the walker when the seat is immobilized in the locked position and prevented from rising or falling. That is, the user can continue to move and walk with the walker with his weight fully and passively supported when the seat and spring means are locked.

The user can maneuver himself or herself adjacent to a seat, chair, bed or toilet and lower himself to a desired height such as the elevation of a seat, chair, bed or toilet onto which the user intends to transfer. Once the desired elevation of the seat is reached, the user can lock the locking lever on the spring means preventing further vertical movement of the seat, and then slide or roll onto the seat, chair, bed or toilet. The user then is able to transfer from a standing to a sitting position at a gentle gradual rate instead of collapsing heavily onto a seat, chair, bed or toilet.

It should be appreciated that the user can also slide off the seat of the walker while in a standing or partially standing position without the seat continuing to push up against the user and unbalance the user if the locking lever on the spring means is activated thereby preventing further vertical movement of the seat. This allows the user to remove himself without contending against an unweighting force that could potentially cause the user to lose his balance.

The ability to rapidly and independently change the height of the seat allows the user to transfer from standing to sitting and vice versa in less time, less effort and less expenditure of energy than would be required if a caregiver was needed.

The user's body is in contact with the seat and front body support which provides stability while walking. The balance of the user is maintained as the walker is propelled forward through the body's contact with the seat and front body support. For many users no contact with the hands upon the walker is required to propel the walker forward or for balance although a user may choose to do so.

During walking or standing with partial weight support, if the user experiences an uncontrolled weakness in the body so that his legs are unable to support him, the user and seat assembly will be arrested in its downward movement so that the user will not fall to the ground. A stop collar, block or other stop limiting means made from a cushioned or elastic material will limit the downward movement of the seat and provide a fixed position for the seat. The user can further lock the seat in the down position close to or at the stop limiting means by activating the lock lever on the spring means.

In a preferred embodiment, the weight support spring means comprises a charged pneumatic cylinder having a movable piston rod extending from the cylinder. The piston rod retracts in part into the cylinder in response to a user's weight-bearing force and extends out from the cylinder as less weight-bearing force is applied to the spring means. The elevation of the seat, seat assembly and user is changed as the user desires by activating the locking and release mechanism on the charged pneumatic cylinder. The locking and release mechanism on the charged pneumatic cylinder can be locked and released in rapid succession or in a rapid repeated or varying sequence as the user changes and adjusts the elevation of the seat supporting him with partial or full weight support. The locking and release mechanism on the charged pneumatic cylinder which in conjunction with the introduction or removal of a force upon the seat results in a retraction or extension of the piston comprises a sealed cylinder containing a pressurized gaseous material which is released for movement among chambers within the gas cylinder. The chambers within the gas cylinder are opened or closed by the compression or release of a pin which is controlled by a control lever.

The charged pneumatic cylinder provides a near constant supporting force to the seat assembly and user regardless of how fully retracted or extended the piston rod is in relation to the cylinder. Thus the user should experience little if any change in a partial weight bearing force as the user rises and falls from a sitting to a standing position and vice versa and whether the user is in a standing, partially standing or sitting position. This is in contrast to weight support means which rely on a helical or coiled spring. Helical or coiled springs impart a more variable change in force as the helical or coiled spring changes from a stretched, extended state to a highly compressed state.

In a preferred embodiment, brake means are coupled to the wheels of the walker to hold the walker firmly in place as a user slides or rolls onto the walker from a sitting position and lifts himself or herself into a standing position and vice versa from a standing position to a sitting position and as one slides off onto a chair, seat, bed or toilet. Similarly, the brake means can hold the walker firmly in place against unintended movement if the user is resting on the seat of the walker whether in a standing or sitting position. The brake means can be activated by either a foot or hand activated friction or clamping brake which restrains movement of the wheels.

In an alternative embodiment, the walker is capable of being folded on its frame to reduce its overall dimensions to facilitate the carrying, transporting and storing of the walker.

It is a general object of this invention to increase the independence of those individuals with impaired physical strength or functioning and to reduce the dependence and workload upon caregivers.

It is an object of the invention to help caregivers and physical therapists in lifting and supporting the patient-user's weight and balance which allows the caregivers and therapists to focus on other parts of the patient's body and its functions and to minimize injuries to caregivers and therapists from lifting and supporting body weight and balance.

It is an object of the invention to enable those individuals with insufficient leg strength to walk and stand up or to enable those individuals who otherwise are unable to take more than a few steps or walk more than a short distance with a walker to walk greater distances independently and to engage in the often required and repeated sequence of transferring from a sitting to a standing position and vice versa safely with a minimal expenditure of energy.

It is an object of the invention to enable those individuals in a weakened physical condition to walk greater distances with a walker without becoming fatigued than they otherwise would be able to do with standard walkers.

It is an object of the invention to provide a walker which enables the user to walk, move, stand and sit down without the need for the upper extremities to hold onto the walker and for the user to maintain pelvic stability and balance.

It is a general object of the present invention to provide a walker which assists those individuals in need of rehabilitative activity but have little confidence and considerable doubt or fear in their ability to stand up, move and walk, to overcome their lack of confidence, fear or doubt so that they may independently stand up, move or walk.

It is an object of the invention to provide inactive or wheelchair-bound patients with a novel exercise walker that can be used for gaining leg strength and exercise.

It is an object of the invention to provide a rehabilitation walker for persons attempting to recover, mitigate or reverse atrophy of muscles through prolonged inactivity or convalescence due to such medical conditions or injuries including, but not limited to, hip and knee replacement and fracture, leg and foot fractures, stroke, spinal cord injuries, single-leg amputees, double-leg amputees with prostheses, cerebral palsy, spinal bifuda, muscular dystrophy, Parkinson's Disease, multiple sclerosis or obesity.

It is further an object of the invention to enable individuals suffering from the aforementioned conditions or injuries to be able to independently walk, stand, rest, sit and transition from sitting to standing and vice versa with the use of the walker so that they can live a fuller life without depending on help from others and reduce the work load of caregivers.

DETAILED DESCRIPTION OF THE PREFERRED EMBODIMENT

Figure 1:
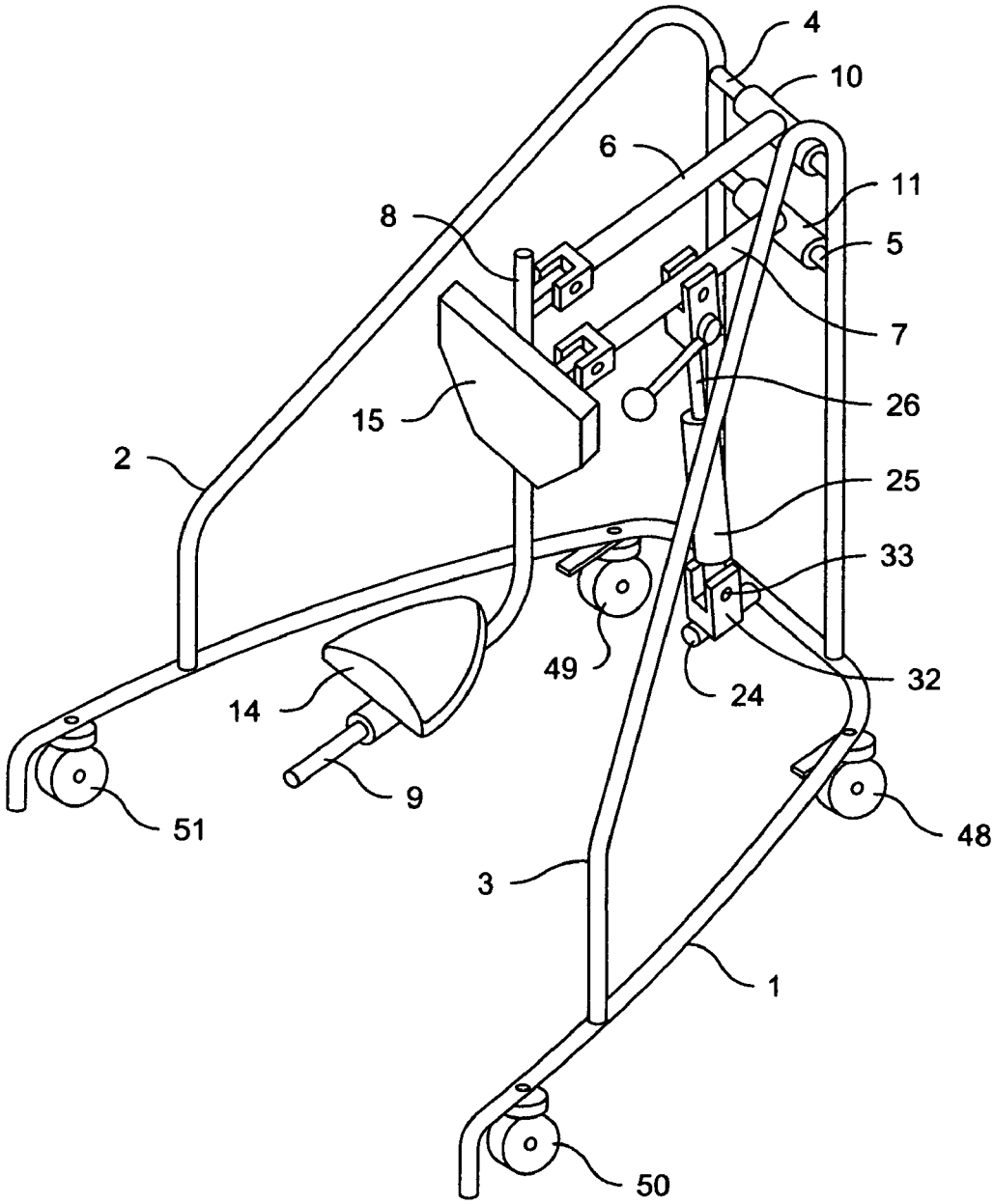
FIG. 1 is an isometric perspective view of the invention.
Figure 2:
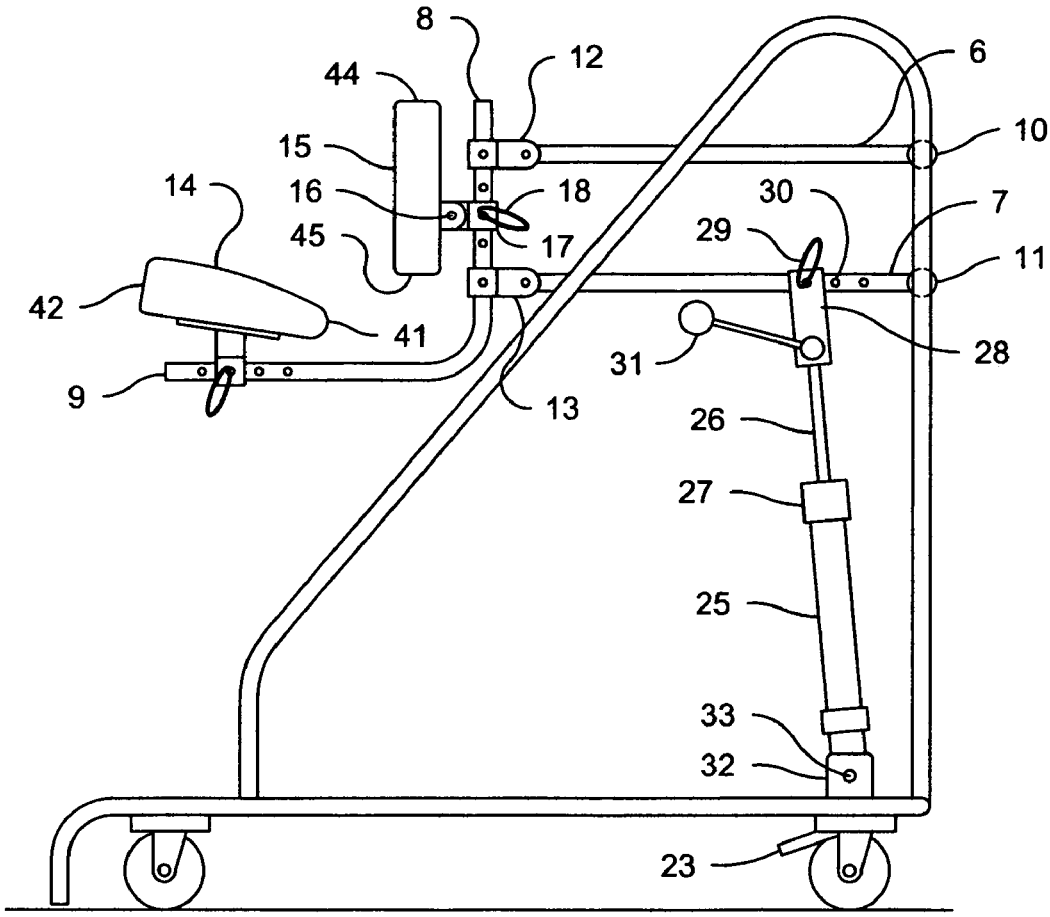
FIG. 2 is a side view of the invention of FIG. 1.

Referring now to the drawings, the invention is shown generally in FIGS. 1 and 2 and in this preferred embodiment includes a support frame assembly with a frame base 1 and two arcuate side members 2 and 3, connected through two cross bars 4 and 5.

The frame including the arcuate side members, cross bars and frame base is preferably made from a strong lightweight tubing material such as aluminum. Each arcuate side member has two ends affixed to a frame base 1. Each end of the arcuate side member is positioned upon the frame base 1 in close proximity to rollable castered wheels 48, 49, 50 and 51. The rollable castered wheels can all swivel or be freely rotatable about a vertical axis. Alternatively only the front wheels 48 and 49 may swivel with the rear wheels 50 and 51 being non-swiveling or the opposite namely, the rear wheels may swivel with the front wheels being non-swiveling.

A position stabilizing arm 6 with two ends and support lever 7 with two ends are provided which are of equal length, parallel to each other and extend from separate cross bars 4 and 5 of differing elevations to a front body support post 8. The position stabilizing arm 6 and support lever 7 are each rotationally connected at one of each of their ends to their respective cross bar 4 and 5 with sleeve connections 10 and 11 in which said sleeve connections are wrapped around their respective cross bars which permits rotational movement around the cross bars. The position stabilizing arm 6 and support lever 7 are each rotationally connected at rotational connections 12 and 13 to the front body support post 8 at their other ends.

The support lever 7 is attached to a body weight support spring means 25. The spring means 25 lowers or raises the support lever 7. The position stabilizing arm 6 is likewise lowered or raised in tandem with the support lever 7 in response to the activation of the spring means 25. The spring means lowers or raises the seat assembly comprising the seat 14, seat support extension 9, front body support 15 and front body support post 8 simultaneously with the lowering or raising of the support lever 7 and position stabilizing arm 6.

In the preferred embodiment of the invention, the support lever 7 is at an elevational height below the position stabilizing arm 6. It should be understood that, in an alternative embodiment, the support lever 7 can be positioned above the position stabilizing arm 6 so long as the support lever 7 and position stabilizing arm 6 remain parallel to each other and the support lever 7 and position stabilizing arm 6 are of the same length.

As the seat 14 is lowered toward or raised away from the ground surface through the activation of the spring means, which will be described in more detail hereinafter, the seat 14 and front body support 15 maintain a constant angle with respect to a flat ground surface. The rotational sleeve connections 10 and 11 and rotational connections 12 and 13 at the ends of both the position stabilizing arm 6 and support lever 7 along with their parallel orientation and equality of length enable the seat to rotate or swivel to the degree necessary to maintain the seat 14 and front body support 15 at a constant angle with respect to a flat ground surface. The maintenance of this angle with respect to a flat ground surface imparts stability and balance to the user. The preservation of this angle facilitates pelvic stability and aids in enabling the stabilized fit imparted by the seat and front body support to be realized. The preservation of this angle with respect to the ground surface allows the user to maintain his body orientation, posture and pressure points upon the seat and body support as he switches back and forth between standing, partially standing and sitting positions and thereby maintain balance.

Figure 6:
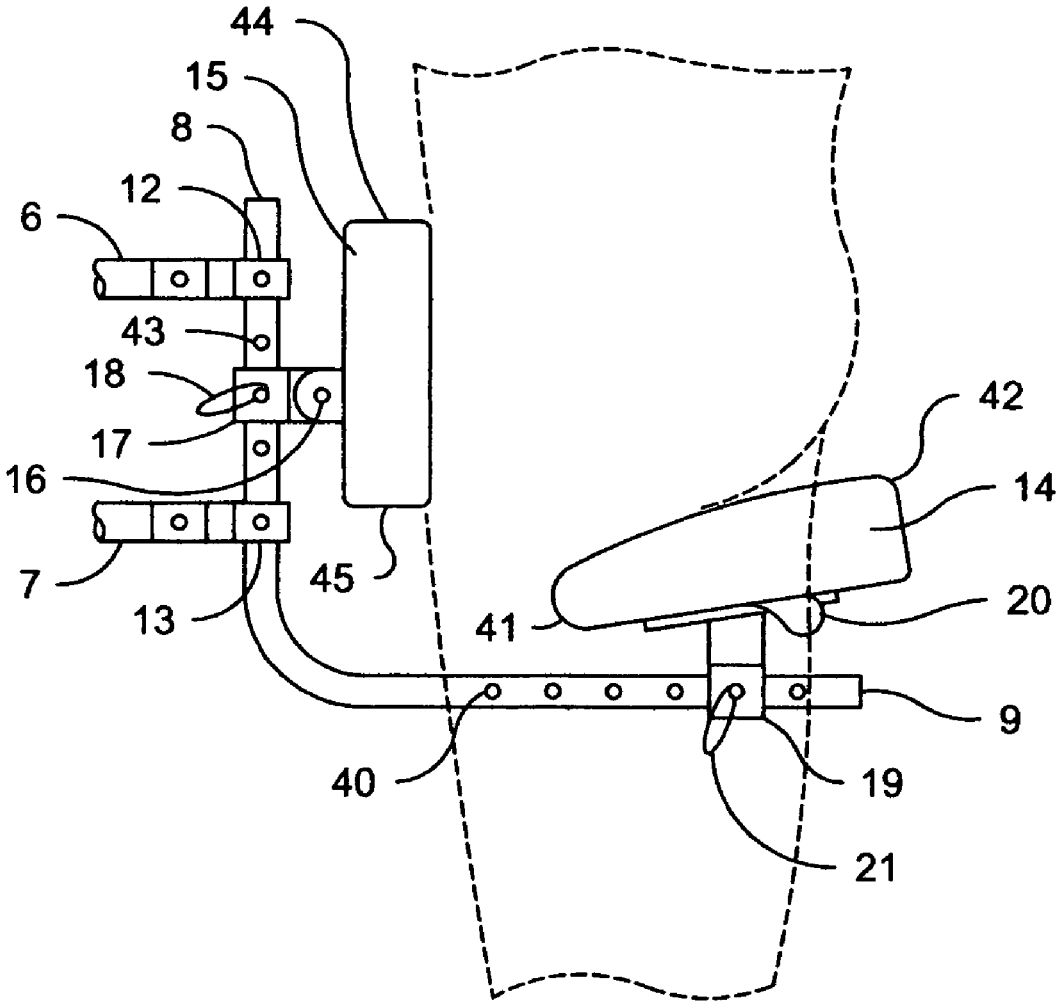
FIG. 6 is a side perspective view of the seat, seat support extension, front body support and front body support post with a user.
Figure 11:
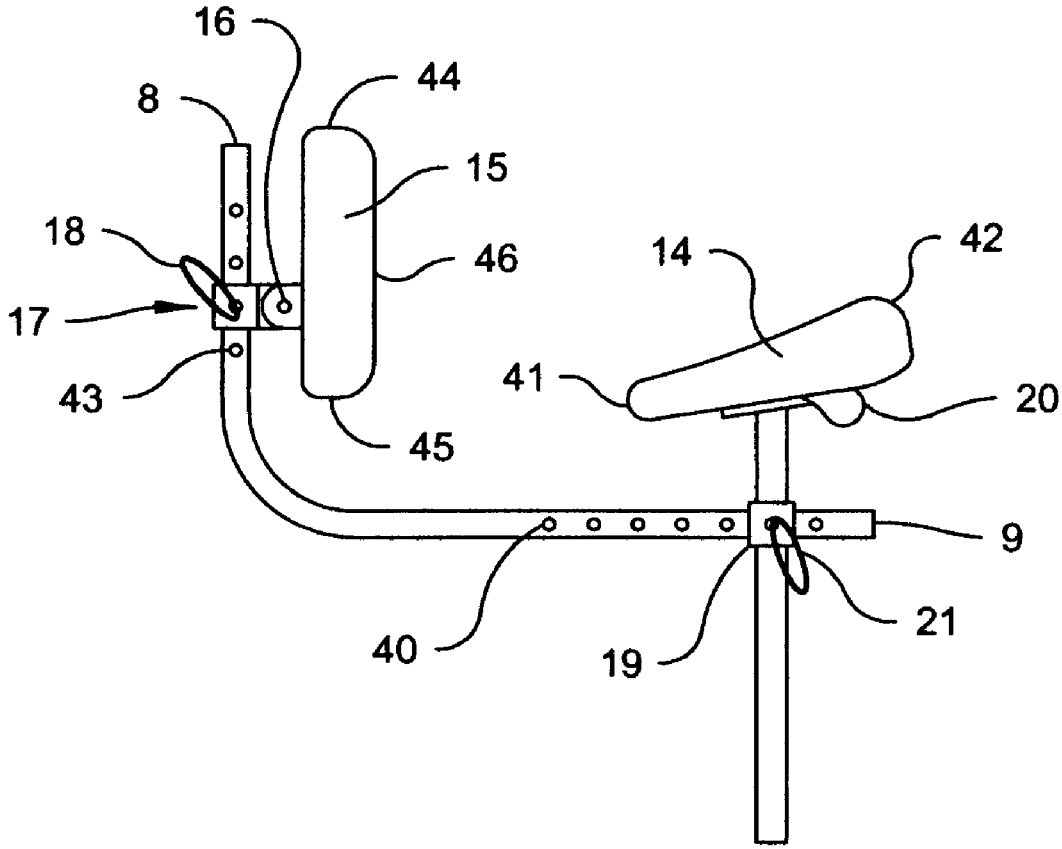
FIG. 11 is a side perspective view of the seat assembly.

Reference is made to FIGS. 6 and 11 showing a side view of the seat 14 in a preferred embodiment. The seat has a broad width in the back to support a user's posterior and tapers to a narrower width in the front of the seat. The seat is mounted on a seat support extension 9. The seat support extension 9 connects to the front body support post 8.

In a preferred embodiment, the front body support post 8 and seat support extension 9 are separate portions of a continuous curved member in which the seat support extension portion 9 and the front body support post portion 8 are disposed at an angle close to 90 degrees or slightly in excess of or less than 90 degrees (see FIGS. 6 and 11).

The seat can be adjustably positioned along the seat support extension 9 by means of a seat support extension connector 19 which slides along the seat support extension toward or away from the front body support 15. The seat can be locked into position by means of an adjustment pin 21 with a loop to facilitate the removal or insertion of the pin into any one of the several regularly spaces openings 40 along the seat support extension 9. The seat front 41 can be tilted downward or upward with the seat back 42 correspondingly tilted upward or downward by means of a seat tilt adjustment lever 20 which activates loosening means to allow the tilt of the seat to be adjusted or tightening means to lock the tilt of the seat into a fixed position. Alternatively an adjustment nut can activate the loosening or tightening means.

The front body support 15 is adjustably positioned upon the front body support post 8 by means of a front body support connector 17 which slides along the front body support post 8 in a substantially vertical up or down direction. The elevational height and position of the front body support can be locked by means of an adjustment pin 18 with a loop to facilitate the removal or insertion of the pin into any one of the regularly spaced openings 43 along the front body support post 8. The front body support 15 is attached to the front body support post 8 by a swivel joint 16 allowing the front body support to tilt or swivel so that the front body support top edge 44 can move either toward or away from the seat 14 as the front body support body bottom edge 45 correspondingly moves in the opposite direction either away from or toward the seat. The front body support will swivel as the user's body contacts the front surface 46 of the front body support and in response to the movement of the user's body while walking or moving.

In a preferred embodiment, the front body support 15 has a padded, flat or slightly contoured surface for contact with the user's body. In the preferred embodiment, the bottom edge 45 of the front body support is adjusted to contact against the pubic bone of the user and the top edge 44 of the front body support 15 is generally positioned in the waist area.

In the preferred embodiment, the seat is adjusted so that the seat front 41 is tilted slightly downward with the seat back 42 tilted correspondingly upward (FIGS. 6 and 11). The seat and front body support form an angle less than ninety (90) degrees. The user fits into this space defined by the less than ninety degree angle. The user, when positioned upon the seat which is tilted in this downward direction, is wedged against the front body support which swivels to firmly contact the body of the user. The seat back 42, with its broad width, is in a raised position supporting the posterior of the user while the user is snugly wedged against the front body support 15 which supports the pelvic area of the user. Thus, the user is aided in maintaining his or her body position, posture and balance as he walks, stands or sits. The body position, posture and balance is further maintained by the preservation of the angle of the seat and front body support relative to the flat ground surface as the center of gravity of the user moves up and down as he walks or changes from a standing to a sitting position or vice versa.

In an alternative embodiment, the front seat support can be shaped to support the abdomen or chest of the user or to include arm supports and rests.

In an alternative embodiment, straps can be provided which are attached at either or both the front body support or seat and wrap around the user to provide additional support and balance.

Figure 12:
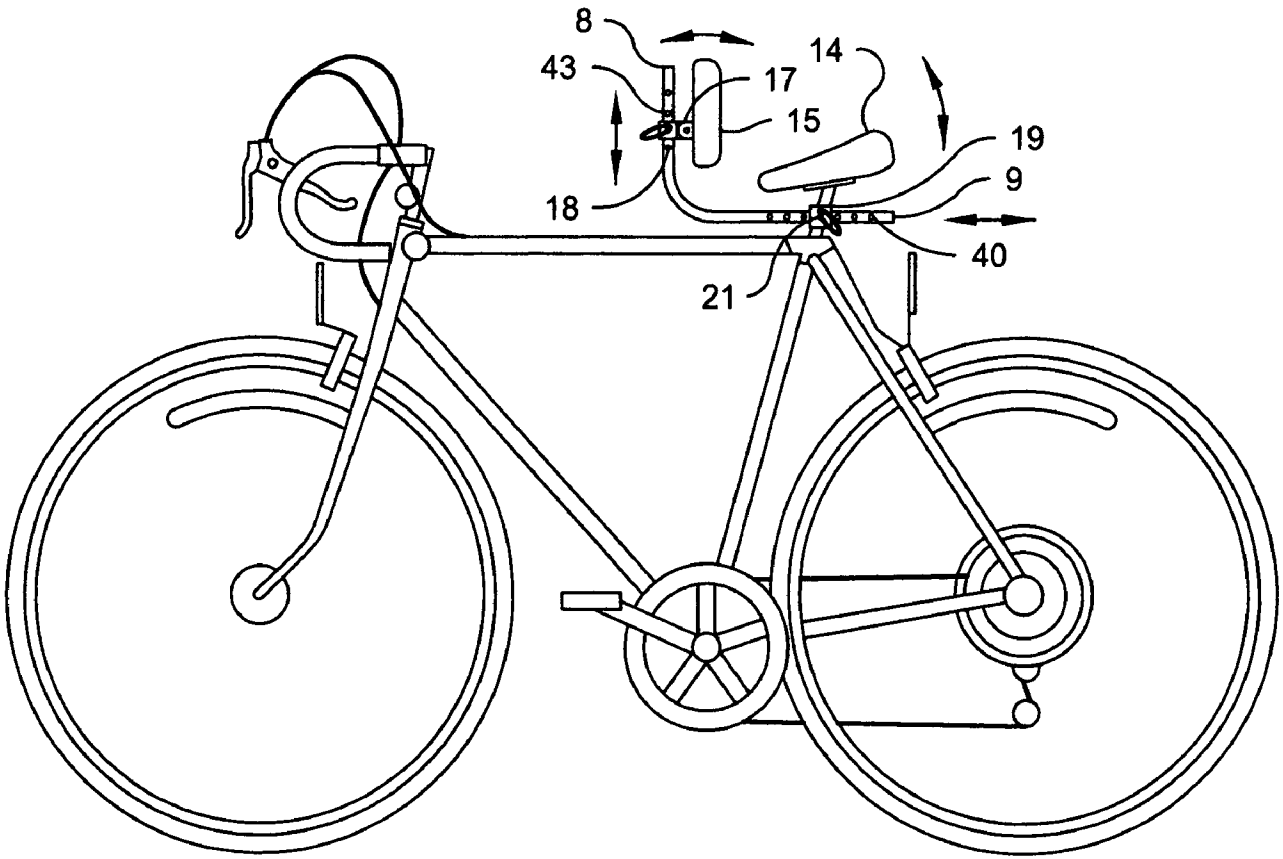
FIG. 12 is a side perspective view of the seat assembly for a bicycle.
Figure 13:
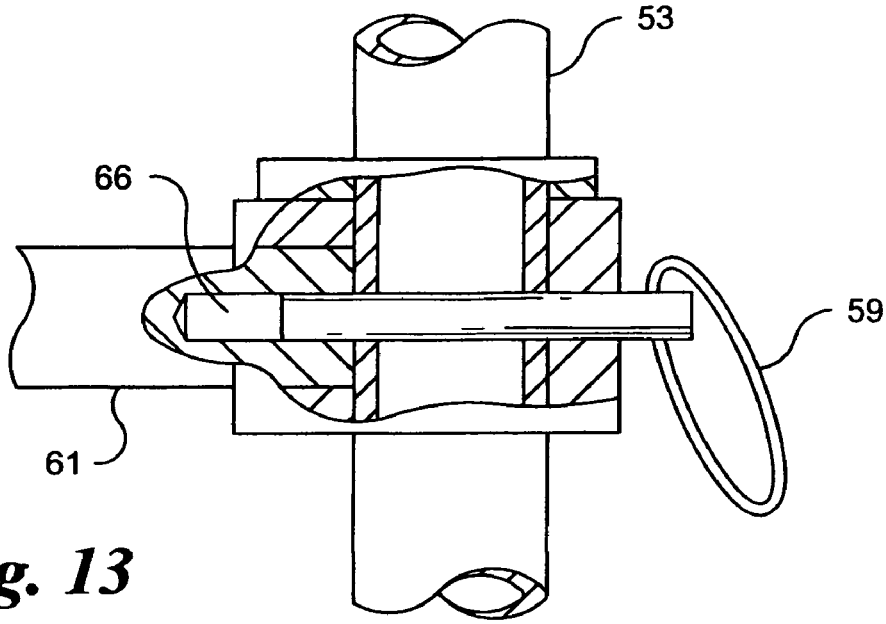
FIG. 13 is an enlarged broken section view of the interior of that portion of the walker where a locking pin, crossbar and an arcuate side member intersect, with part of the front surface removed to show this intersection of components.
Figure 14:
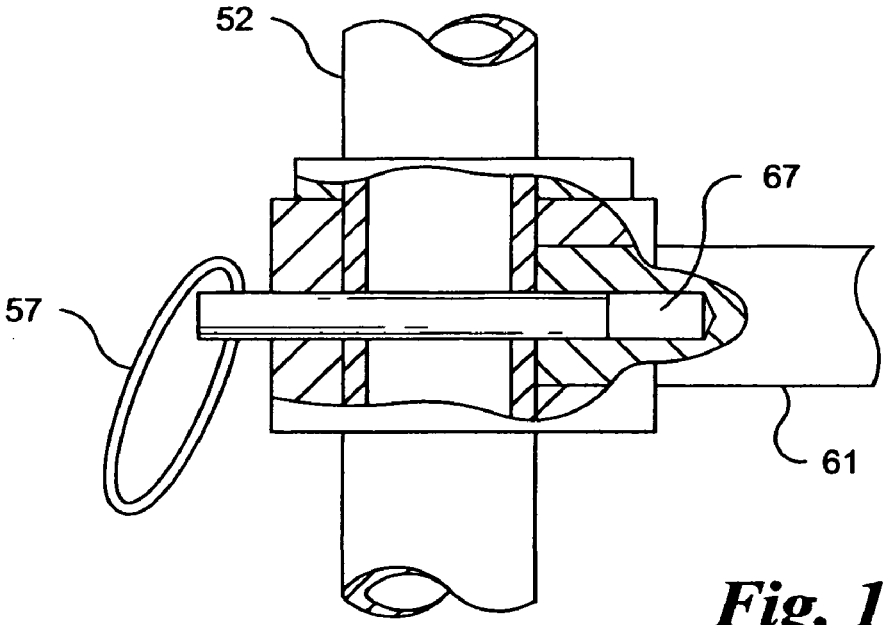
FIG. 14 is an enlarged broken section view of the interior of that portion of the walker where a locking pin, crossbar and another arcuate side member intersect, with part of the front surface removed to show this intersection of components.
Figure 15:
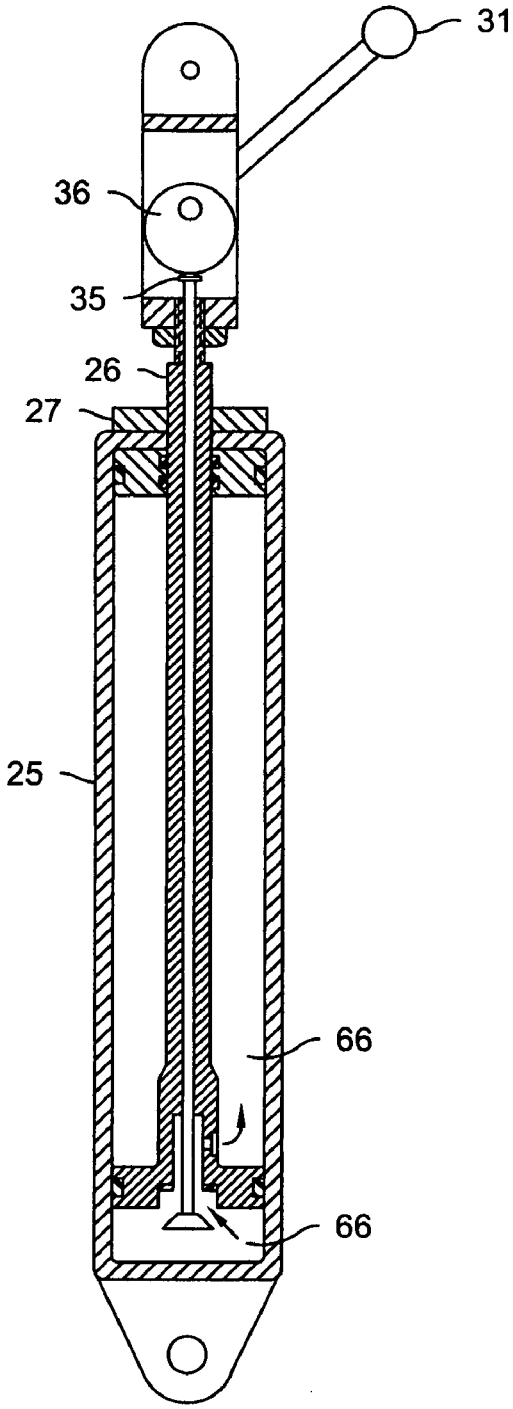
FIG. 15 is a vertical section view of the body support spring means shown in FIG. 5 at a right angle to the section 7B-7B shown in FIG. 5 in its preferred embodiment of a pressurized gas cylinder in its activated position allowing for movement of the pressurized gas within the chambers of the gas cylinder .
Figure 16:
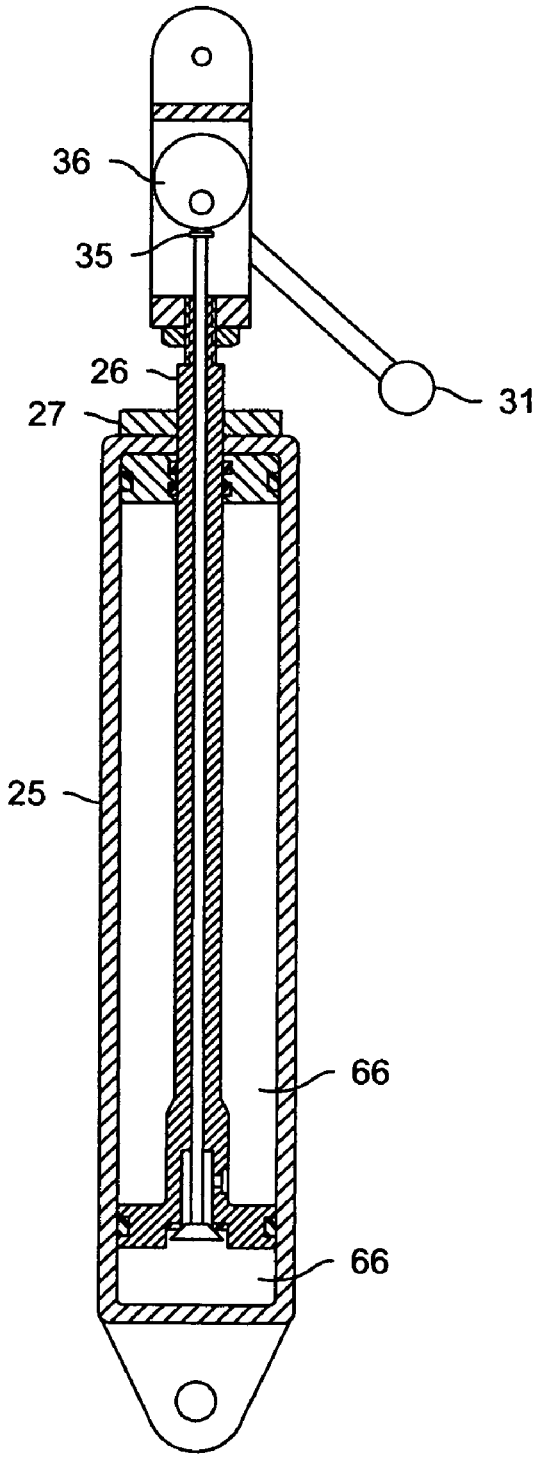
FIG. 16 is a vertical section view of the body support spring means shown in FIG. 5 at a right angle to section 7B-7B shown in FIG. 5 in its preferred embodiment of a pressurized gas cylinder in its closed or locked position which limits the movement of the pressurized gas within the chambers of the gas cylinder.

The seat assembly as depicted in FIGS. 6 and 11 includes the seat, seat support extension, front body support and front body support post with the position adjustment means and tilt means can be used in a variety of applications other than walkers. Applications for the seat assembly in addition to its application in a walker, include not by way of limitation, use in bicycles, stationary exercise pedaling equipment or as a chair for an office desk or high draftsman table at which a user either sits or is in a semi-standing position. FIG. 12 depicts the seat assembly on a bicycle.

Figure 5:
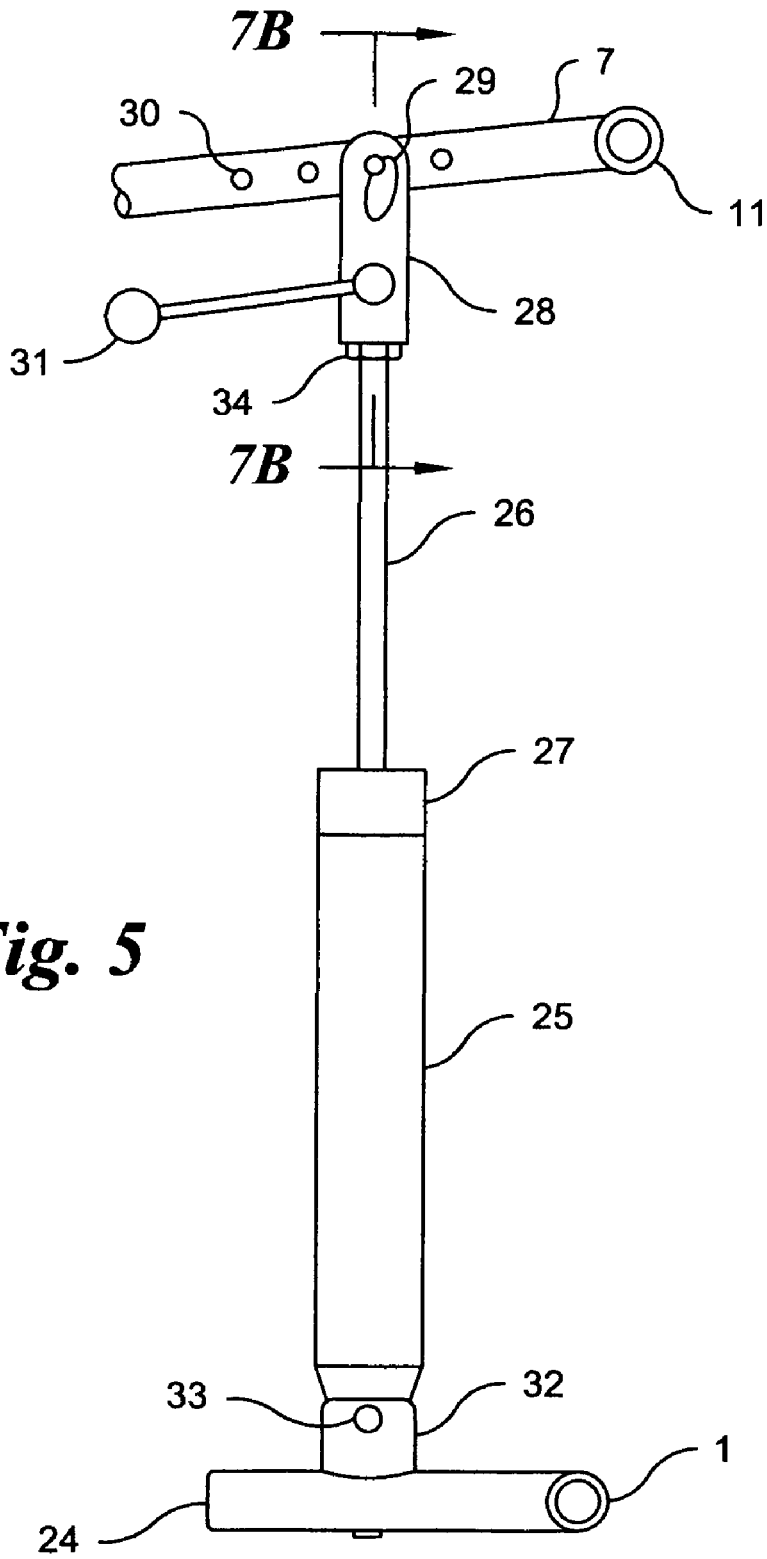
FIG. 5 is an enlarged side view of the body weight support spring means with its connections at both ends to the walker.

In the preferred embodiment and with reference to the Figures especially FIG. 5, the weight support spring means is a gas spring or a charged preloaded gas cylinder 25. The gas cylinder is provided with a piston rod 26 extending upward toward a U-shaped connector 28.

The U-shaped connector 28 houses an ex-center circular disk 36 through which a control lever shaft 37 passes. The U-shaped connector has openings to allow the passage of the control lever shaft 37 through the sides of the U-shaped connector to contact the ex-center circular disk 36. As depicted in FIG. 7 an end of the piston rod 26 is positioned adjacent to the gas control pin 35 within the U-shaped connector 28. A stabilizing piston rod nut 34 is positioned around the piston rod 26 where the piston rod 26 is connected to the U-shaped connector 28. The stabilizing piston rod nut 34 securely limits any rotational or horizontal sideways movement of the piston rod while permitting the piston rod freedom of movement into and out of the gas cylinder. The U-shaped connector 28 is connected to the support lever 7 by an adjustment pin 29 with a loop to facilitate the removal or insertion of the pin into any one of the several regularly spaced openings 30 along the support lever 7. The gas cylinder is rotationally connected to the bottom of the support frame at a support frame base extension 24 by a rotational connector 32 secured with a rotational pin 33. The gas cylinder can pivot rotationally about the rotational connector 32 and rotational pin 33 as the U-shaped connector 28 and adjustment pin 29 are positioned at selected locations along the spaced openings 30 of the support lever and locked into place at one of the spaced openings 30.

The gas cylinder and piston rod may be reversed in their orientation so that the gas cylinder may be connected to the support lever by the adjustment pin 29 which is inserted into one of the spaced openings 30. In this reverse orientation the piston rod is rotationally connected to the frame extension 24 by the U-shaped connector 28. The U-shaped connector is rotationally connected to the frame base extension 24 by rotational pin 33 which is inserted into the rotational connector 32. In this reverse orientation the gas control pin 35 is compressed or released by means of cable wires. The cable wires can be activated by hand or foot to rotate the off center disk 36 directly or to rotate the control lever shaft 37 which in turn rotates the off center disk 36 to compress or release the gas control pin 35 to lock or unlock the weight support means.

Figure 3:
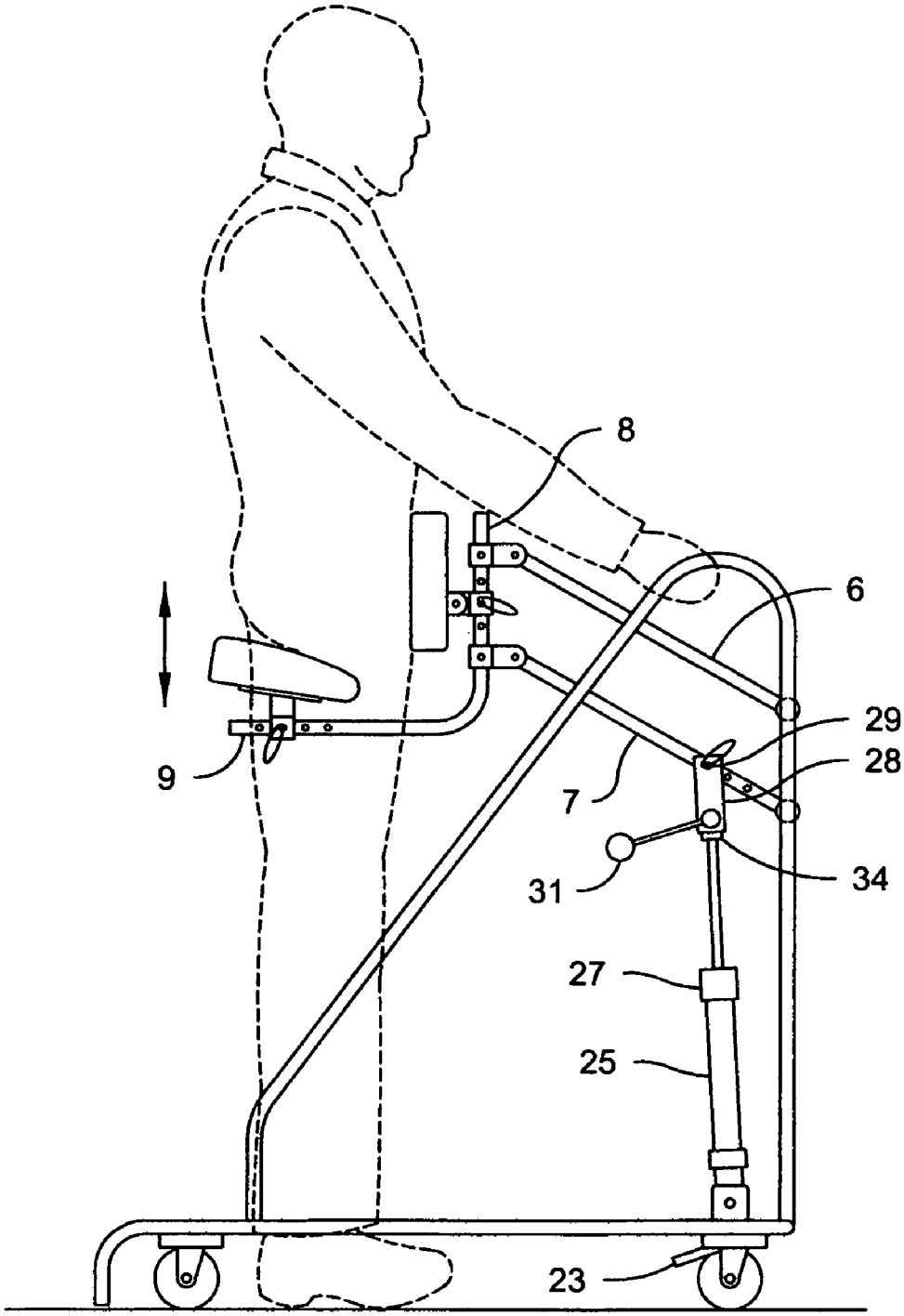
FIG. 3 is a side view of the invention in the standing position with a user.
Figure 4:
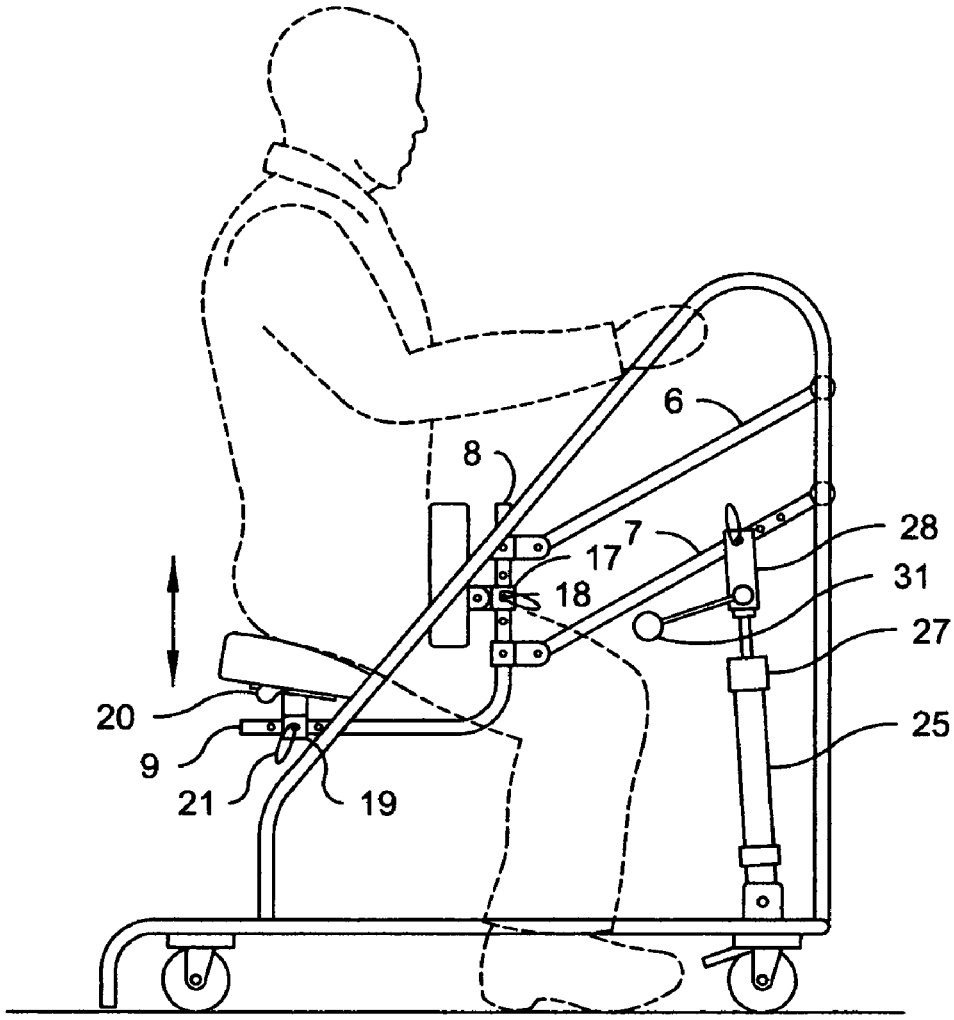
FIG. 4 is a side view of the invention in the sitting position with a user.

The gas cylinder's connection to the frame base extension 24, as generally shown in FIGS. 2, 3 and 4, is positioned so that the weight support spring means is approaching a perpendicular angle to the support lever or is positioned to minimize the deviation from a perpendicular angle of the angle formed between the lengthwise axis of the spring means and the support lever. The maintenance of a perpendicular angle or close to a perpendicular angle allows for the transmission of the supporting forces with maximum efficiency and with minimal negation of the mechanical advantage obtained as the distance increases between the pivot point of the support lever 7 on the cross bar 11 and the support lever's connection with the spring means at the U-shaped adjustment pin 29.

Connecting the weight support spring means at different locations with the adjustment pin 29 along the support lever 7 at one of the openings 30 will result in a varied supporting force or unweighting force applied to the support lever 7, seat 14 and user. As the distance between the pivoting axis of the support lever on the cross bar 11 of the frame and the connection of the weight supporting spring means into one of the openings 30 along the support lever 7 with adjustment pin 29 increases, the mechanical advantage of the force supplied by the gas spring increases.

In the preferred embodiment the placement of the U-shaped connector 28 and adjustment pin 29 along the support lever in a direction toward the seat will result in a greater support force imparted to the seat and user while placement toward the cross bar 11 will result in a lesser support force imparted to the seat and user. The amount of supporting force desired to be exerted upon the seat and thereby the user positioned upon the seat can be adjusted depending on the weight of the user and the degree of weight support assistance the user requires in walking, standing or sitting.

In an alternative embodiment, the location of the connection between the support lever 7 and spring means 25 can be moved and locked into place by a turning screw mounted on the cross bar which moves the support lever toward or away from the cross bar 11 by a threaded sleeve which is mated with grooves inside the support lever. Turning the screw will adjust the support force imparted to the seat and user.

Refer now to FIG. 5 where is shown the weight support spring means in a preferred embodiment. The weight support spring means consists of a gas-charged cylinder 25 into which a piston rod 26 retracts or out of which the piston rod extends. The gas cylinder is preloaded with pressurized gas which is held in sealed chambers within the cylinder. Depending on the individual user the gas cylinder can be changed to provide a supporting force which fully supports or partially supports that individual's supporting weight requirements. Different gas cylinders can be employed to accommodate children or those weighing less than 100 pounds to those weighing over 300 pounds. Additionally, when an individual user's weight support needs change as he becomes stronger or weaker the gas cylinder can be changed to provide the appropriate amount of support required.

Figure 7A:
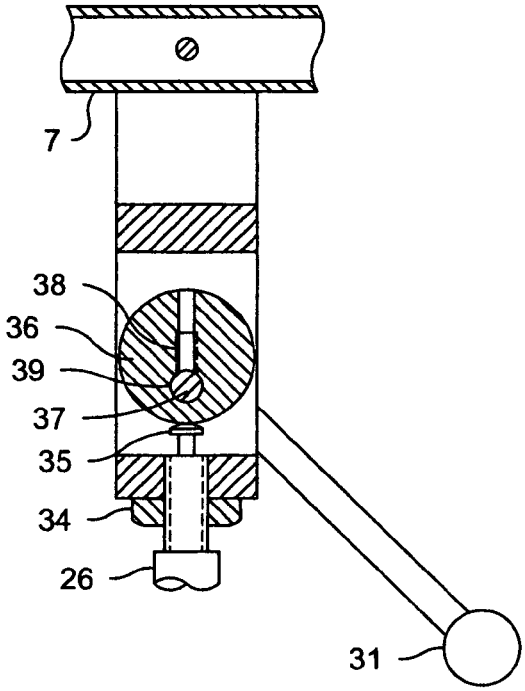
FIG.7A is a section view of a part of the body weight support spring means including the piston rod, U-shaped connector, off center disk, compression pin and control lever in the directions of the arrows 7A-7A in FIG. 7B.
Figure 7B:
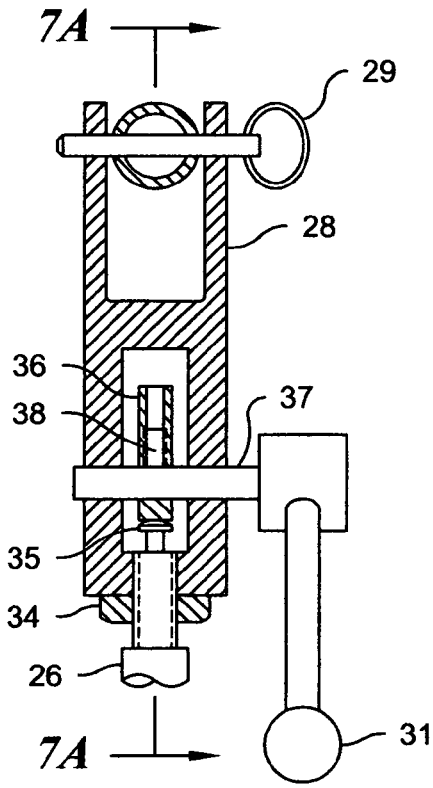
FIG. 7B is a section view of a part of the body weight support spring means including the piston rod, U-shaped connector, off center disk, compression pin and control lever in the directions of the arrows 7B-7B in FIG. 5.

The'gas cylinder has a control lever 31 as in FIGS. 7A and 7B. A control shaft 37 is connected to the control lever 31 at one end and extends at its other end onto the surface of or through an opening 39 of the off center circular disk 36. The contact point of the control lever shaft 37 onto the surface of the off center circular disk 36 or opening 39 of the off center circular disk 36 is not at the center point of the off center circular disk 36 but rather is at an off center location of the disk 36. A locking screw 38 clamps down the control lever shaft 37 to the off center circular disk 36. When moved the control lever 31 travels in a circular arc which rotates the control lever shaft 37 which in turn rotates the off center circular disk 36. As the off center circular disk rotates in an off center fashion it will either compress or release the gas control pin 35. When the control lever is turned to an activated release position the off center circular disk moves the gas control pin 35 disposed adjacent to and in physical contact with the off center circular disk 36. Upon activation the gas control pin's movement releases the pressurized gas for movement within the sealed chamber of the gas cylinder. The pressurized gas exerts a force upon the piston causing the piston to extend out from the gas cylinder. When the pressurized gas is available to move within the chambers of the sealed gas cylinder the piston can move within the cylinder in response to the force applied by the user. As a result the seat assembly and user can move in an up or down direction and can provide partial weight bearing support.

When the user desires to immobilize the seat from up and down movement or desires full weight support the control lever 31 is rotated so that the off center circular disk 36 releases the pin from the activated position to a closed or locked position. In the closed or locked positioned pin 35 limits the movement of the gas within the gas cylinder. In the locked rigid position the piston rod 26 is immobilized and will not retract into or extend from the gas cylinder in response to the force applied by the user. Thus the support lever and seat assembly which are supported by the gas spring's position are likewise maintained in a fixed stationary locus.

When the control lever 31 is turned to the activated released position the pressurized gas transmits its force through the piston rod to provide partial weight bearing support to the user or in some circumstances full weight bearing support. The user with the aid of partial weight support can exert his own muscular effort in the legs and torso to support his walking or standing efforts. The user can let his body weight push the seat down against the gas spring's supporting force to an elevation desired for sitting or for transferring to a chair, seat, bed or toilet and then lock the gas spring into place. This allows the user to slide off the seat with the seat in a fixed stationary position and without the seat exerting an upward force upon the user and risk destabilizing the user.

In general the user can turn the control lever to the locked position whenever he desires to rest whether in a standing, partially standing or non-resting phase or when transferring to a seat, bed, chair or toilet. Similarly, when transferring from a sitting or resting phase the user can turn the control lever to the activated release position when he desires partial weight bearing support to lift himself to a standing or partially standing position and intends to use his own efforts to the extent he is able for exercise or to assist in walking, standing, moving or to partially support himself on his legs. The user can switch the control lever 31 back and forth between the released and locked positions and move from a sitting to a standing or partially standing position which is either in a locked fully supported phase or a dynamic partial weight support phase and is not simply letting the seat passively support him.

The user positioned on seat 14 can transition from a standing to a sitting position by letting his weight gradually lower himself while receiving partial weight bearing support from the weight support spring means 25. The user can then turn the control lever 31 to the locked position while sitting on the seat 14 of the walker and slide off onto a chair, seat, bed or toilet. The user can transition from the chair, seat, bed or toilet to an upright standing position by sliding from a chair, seat, bed or toilet onto the seat 14 of the walker and activating the control lever 31 to lift himself into the standing or more upright position.

The user can move the seat to numerous different elevations by activating the control lever 31 and letting more or less of his body weight rest upon the seat. The height of the seat and the position of the user whether in a standing, sitting or partially standing position can be changed in any desired varied, random or repeated sequence. The amount of weight supporting force the user experiences can be adjusted without changing the gas cylinder by sliding the weight supporting spring means 28 along the support lever 7 either farther from or closer to the fulcrum point of the support lever's rotational connection on the cross bar 11

If the user experiences an uncontrolled or sudden weakening so that his legs cannot support him when the control lever 31 is in the activated position and the gas cylinder or body weight support spring means is providing partial weight bearing support, stop limiting means 27 are provided. The stop limiting means can consist of a stop collar or stop block made from a cushioned force absorbing material. The stop limiting means will arrest the downward movement of the seat to a pre-determined elevation off the ground surface to keep the user from falling and contacting the ground surface.

Front wheels 48 and 49 are connected to the frame base between the frame base and ground surface and are in physical contact with the ground surface. The front wheels 48 and 49 are preferable castered wheels supported for rotation about a vertical axis and swiveled for steering. The vertical axis is defined by a vertical pin connecting the wheels to the frame base through openings in the frame base tubing adapted to receive the vertical pin. Front wheels 48 and 49 and rear wheels 50 and 51 may be either fixed or swiveled to allow for rotation about a vertical axis.

A brake 23 engages either the front or rear wheels by friction or clamping to prevent movement of the walker when a force is applied. The brake can be applied by pushing on a brake lever by hand or foot and the brake released by pulling up on the brake lever by hand or foot. In an alternative embodiment handles positioned on the arcuate side members can activate cables to apply the brakes on the wheels.

Figure 8:
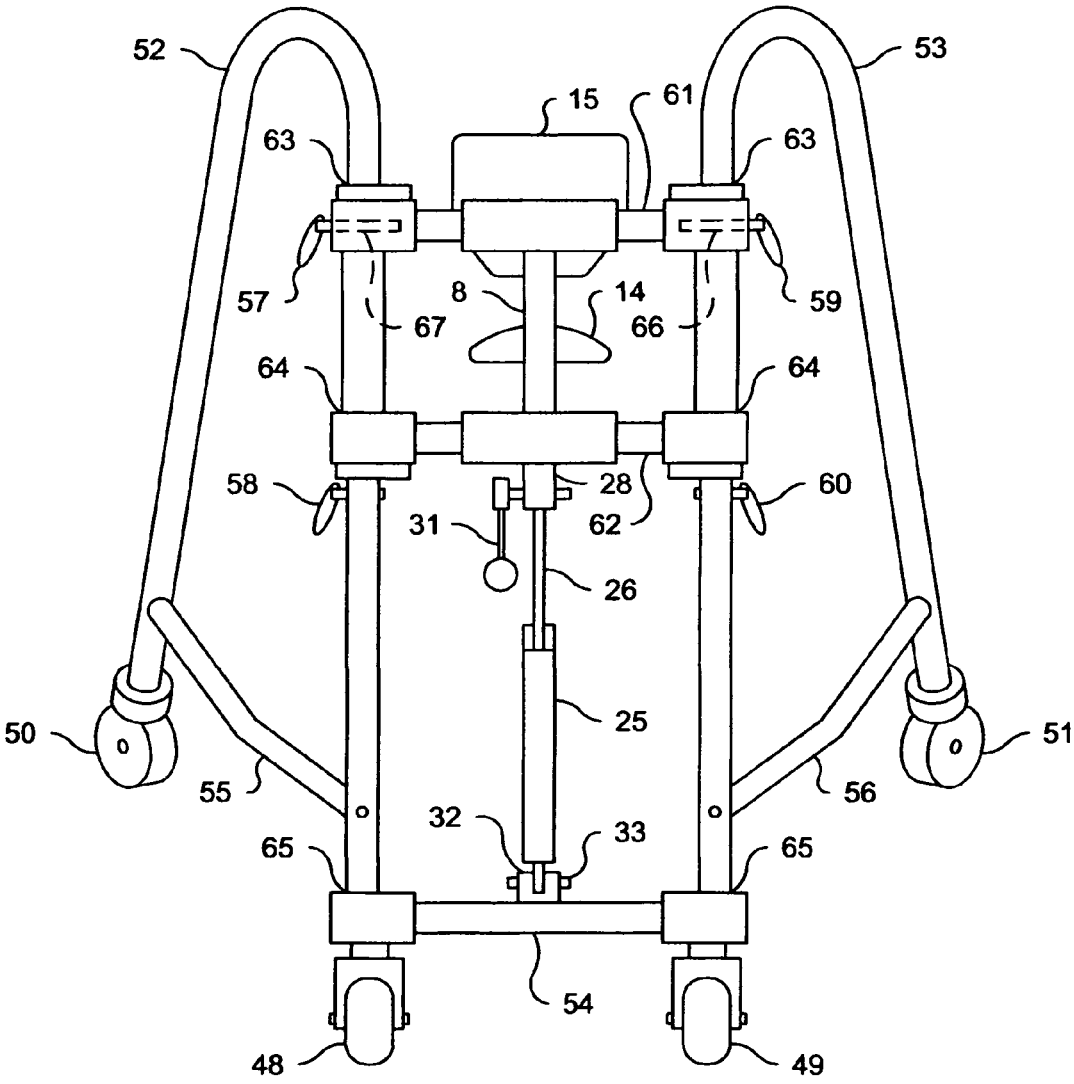
FIG. 8 is a front elevation view of the foldable embodiment of the invention.
Figure 9:
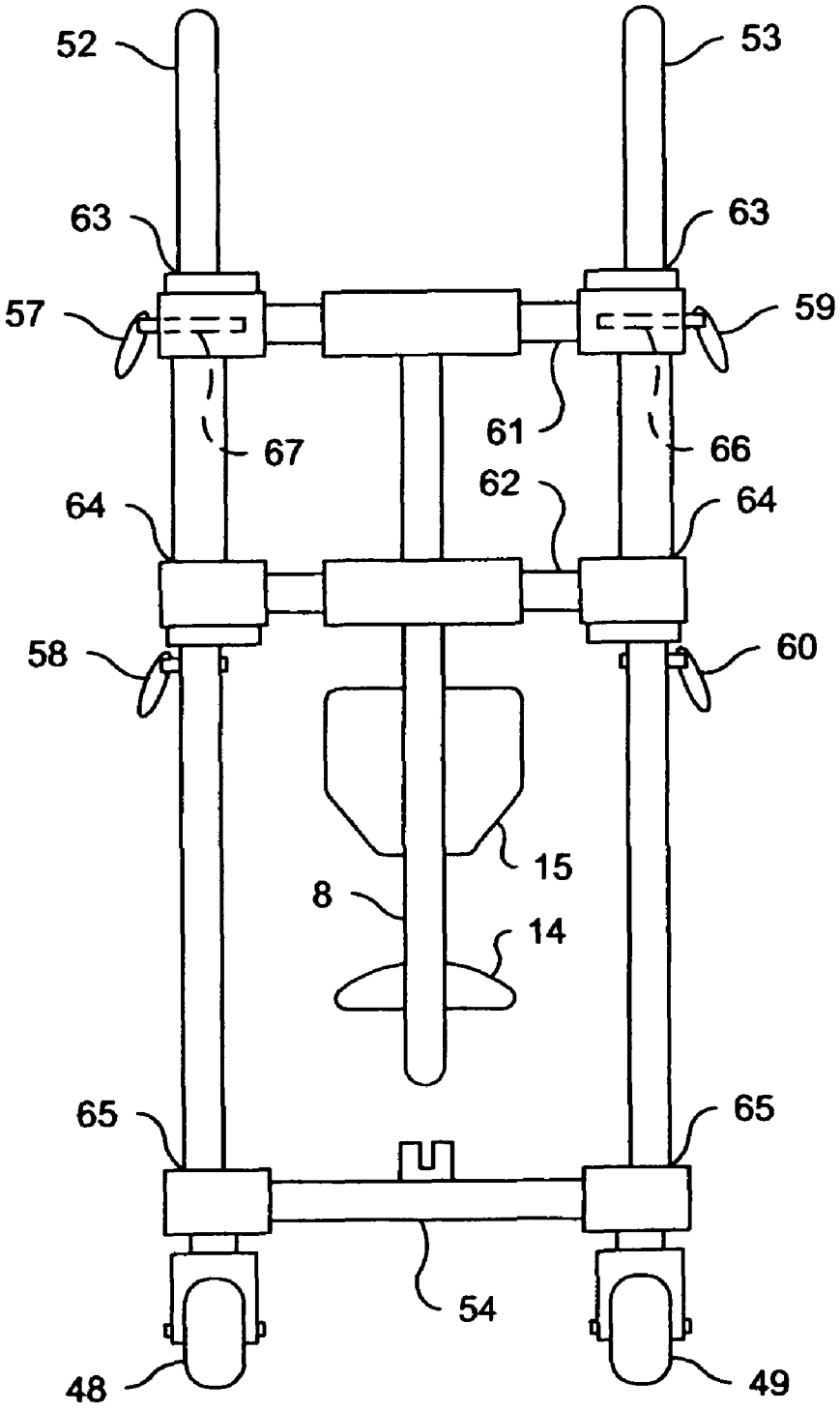
FIG. 9 is a side elevation view of the foldable embodiment of the invention in its folded state.
Figure 10:
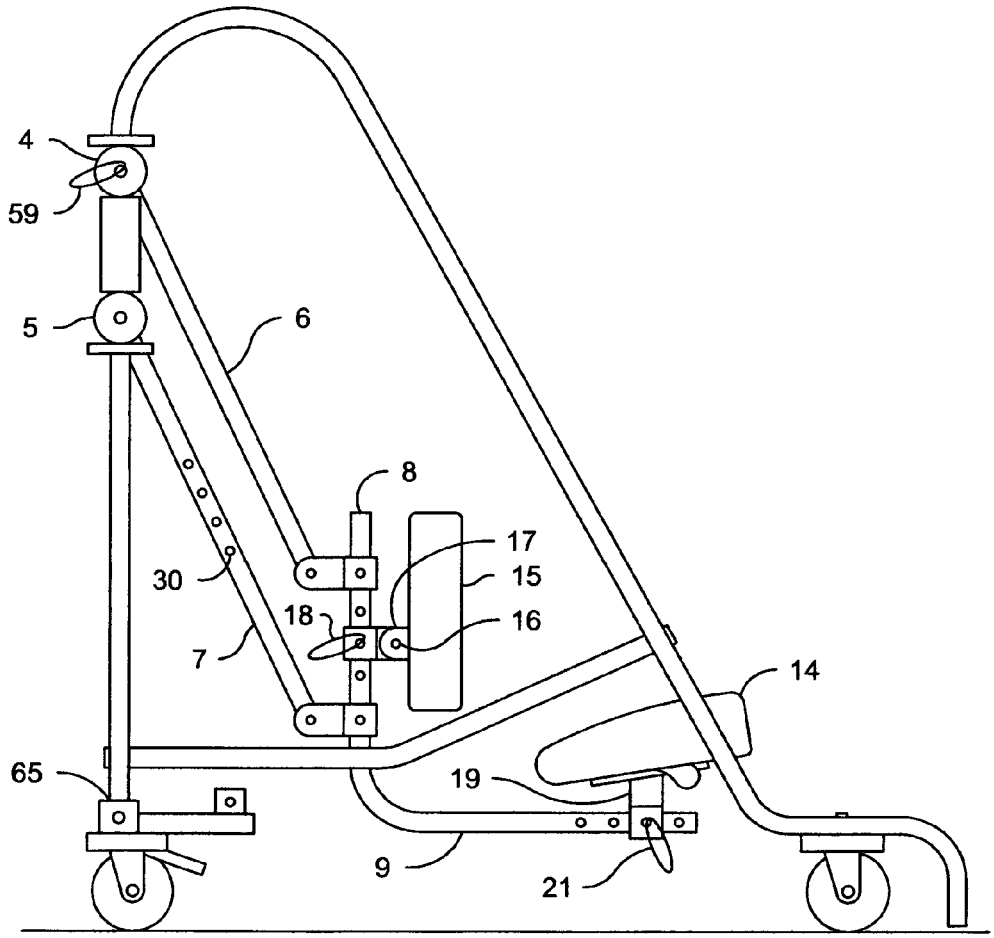
FIG. 10 is front elevation view of the foldable embodiment of the invention in its folded state.

Referring to FIGS. 8, 9 and 10 an alternative embodiment of the invention is shown is which the walker can be folded into a compact shape to facilitate carrying, transporting and storing of the walker. In this foldable embodiment one end of each of the two arcuate side members 52 and 53 are affixed to a lower cross bar 54 in close proximity to and above the two front wheels 48 and 49. The other end of each of the two arcuate side members 52 and 53 is affixed in close proximity and above the two rear wheels 50 and 51. Side member stabilizing crossbars 55 and 56 extend from the front of the walker to the back of the walker along the side of the walker and within a plane defined by an arcuate side member and are connected at each end to an arcuate side member. The side member stabilizing crossbars 55 and 56 impart stability to the walker. Folding pins 57 and 58 connect one arcuate side member 52 to crossbars 61 and 62. Folding pins 59 and 60 connect the other arcuate side member 53 to crossbars 61 and 62. Each arcuate side member extends through openings 63, 64 and 65 of the crossbars 61, 62 and 54. The arcuate side members are held firmly in place by the folding pins 57, 58, 59 and 60. Upon removal of the folding pins the frame consisting of the arcuate side members 52 and 53, side member stabilizing crossbars 55 and 56 and rear wheels 50 and 51 can pivot along a pivotal axis defined by where the side members extend through the openings 63, 64 and 65 of the crossbars 61, 62 and 54. In this manner the frame's side members can be folded inward toward each other thereby reducing the overall width dimension of the walker during storage or transportation of the walker.

The walker can be further collapsed into a more compact overall dimension for transporting, carrying or storing by removing the adjustment pin 29 where the body weight support means connects to the support lever and detaching the support spring means from its connection 32 and 33 on the support frame extension 24 such as by removal of the connection pin 33 or loosening of other means of attachment. The body weight support means can be detached from its attachment to the support lever 7 by removal of the U-shaped connector adjustment pin 29 from one of the support lever spaced openings 30. The support spring means then can be completely detached and removed from the walker. Upon the detachment of the body weight support means at one or both of its ends from the walker the seat assembly will pivot downward on the crossbars 61 and 62 thereby rendering the walker more compact when being transported, carried or stored (see FIGS. 9 and 10).

While the invention has been shown and described herein in what are believed to be the most practical and preferred embodiments, it will be understood that various omissions, substitutions, variations and changes in the forms and details of the invention may be made by those skilled in the art without departing from the spirit and scope of the invention. It is expressly intended that all combinations of these elements which perform substantially the same function in substantially the same way to achieve the same results are within the scope of the invention and that the invention described herein is not intended to be limited to the details disclosed herein but is to be afforded the full scope of the claims so as to embrace any and all equivalent apparatus and articles.

The invention claimed is:

1. A sit down and stand up full step walker comprising:

a support frame;

roller means mounted on said support frame for contacting a ground surface and rolling the frame;

a support lever extending between the support frame and a front body support post and connected rotationally at one end to the post and connected rotationally at the other end to the support frame;

a front body support mounted on the front body support post by a swivel joint so that the front body support can be tilted and can be adjustably positioned along the front body support post up or down, said front body support having a front planar surface;

a seat having a front end and a back end for supporting a user, said seat mounted on a seat support extension connected to the front body support post and wherein the front of the seat is positioned in a direction facing the front body support and the support frame so that the seat positions the user to face the walker to enable the user's body to push the walker in front of the user and wherein the seat can be adjustably positioned along the seat support extension closer toward or further away from the front body support and wherein the seat is adjustably tilted downward so that the user supported by the seat will be wedged between the seat and front body support with the user's abdominal region in contact with the front body support;

a position stabilizing arm positioned at an elevation higher than the support lever and parallel to the support lever, said arm extending between the front body support post and support frame and being rotationally connected at one end to the post and rotationally connected at the other end to the support frame so that the seat and front body support are maintained at a constant angle with respect to a flat ground surface as the position stabilizing arm and support lever move rotationally about the support frame and post;

adjustable body weight support spring means rotationally connected on the support frame for applying a full or partial weight-bearing supporting force to the support lever so that the seat, front body support and user are able to move up or down responsive to the variable force supplied by the user as the user walks, stands or sits;

a control lever mounted on the adjustable body weight support spring means so that upon movement of the control lever an off center circular disk is turned which releases a gas control pin to limit the movement of a pressurized gas within the adjustable body weight support spring means so that the movement of the seat and front body support can be locked at variable fixed elevations including a sitting height position to allow a user to enter or exit the walker from a sitting position and hold the seat, front body support and user in a continuous sitting position without the application of the user's body weight force or force by another person and so that upon further movement of the control lever the off center circular disk is turned to activate the gas control pin to release the movement of the pressurized gas within the adjustable body weight support spring means so that the seat, front body support and user are released from a sitting position or fixed elevation to a standing or walking position supported by the adjustable full or partial body weight support spring means.

2. A walker as set forth in claim 1 wherein said adjustable body weight support spring means comprises a charged gas cylinder having a piston rod extending from or retracting into the cylinder to enable movement of the piston rod in response to force exerted by the user.

3. A walker as set forth in claim 2 wherein the control lever locks the movement of the piston rod extending from or retracting into the cylinder and releases the piston rod to enable movement of the piston rod in response to movement of the user.

4. A walker as set forth in claim 2 wherein the adjustable body weight support spring means is provided with stop means for limiting the downward movement of the seat and for providing a fixed down position of the seat.

5. A walker as set forth in claim 1 wherein the adjustable body weight support spring means can be fixed into position at one of several openings spaced on the support lever to provide a body weight supporting force which varies depending on the fixed position.

6. A walker as set forth in claim 1 wherein the adjustable body weight support spring means is rotationally connected on the support frame at an extension of the support frame so that the spring means is positioned to substantially form a perpendicular angle between a lengthwise axis of the spring means and the support lever.

7. A walker as set forth in claim 1 wherein the support frame includes two arcuate side members each with two ends, a frame base attached to the ends of the arcuate side members and two cross bars each of which has one end connected to one arcuate side member and the other end connected to the other arcuate side member.

8. A walker as set forth in claim 7 wherein the support lever is connected rotationally to a cross bar and the position stabilizing arm is connected rotationally to the other cross bar.

9. A walker as set forth in claim 7 wherein the roller means are rollable castered wheels mounted upon the frame base for contact with the ground.

10. A walker as set forth in claim 9 further comprising brake means for restraining movement of the wheels.

11. A sit down and stand up full step walker comprising:

a support frame wherein the support frame includes two arcuate side members, locking pins and a multiplicity of crossbars with openings through which each opening pass a side member and in which a locking pin passes through an arcuate side member opening and crossbar opening and extends into a crossbar for securing the side member against movement and so that upon removal of each locking pin securing a side member the side member can rotationally pivot within the opening in each of the crossbars and thereby reduce the width of the walker;

roller means mounted on said support frame for contacting a ground surface and rolling the frame;

a support lever extending between the support frame and a front body support post and connected rotationally at one end to the post and connected rotationally at the other end to the support frame;

a seat for supporting a user, said seat mounted on a seat support extension connected to the front body support post;

a front body support mounted on the front body support post;

a position stabilizing arm positioned at an elevation higher than the support lever and parallel to the support lever, said arm extending between the post and support frame and being rotationally connected at one end to the post and rotationally connected at the other end to the support frame so that the seat and front body support are maintained at a constant angle with respect to a flat ground surface as the arm and support lever move rotationally about the support frame and post;

adjustable body weight support spring means rotationally connected on the support frame for applying a full or partial weight-bearing supporting force to the support lever so that the seat, front body support and user are able to move up or down responsive to the variable force supplied by the user as the user walks, stands or sits.

12. A walker as set forth in claim 11 wherein the support frame further includes side member stabilizing crossbars in which each side member stabilizing crossbar has two ends each of which ends is affixed to an arcuate side member at different locations along the same arcuate side member.

* * * * *